US007973483B2

(12) United States Patent
Shin et al.

(10) Patent No.: US 7,973,483 B2
(45) Date of Patent: Jul. 5, 2011

(54) LIGHT EMITTING PIXEL AND APPARATUS FOR DRIVING THE SAME

(75) Inventors: Yun Seung Shin, Seoul (KR); Jong Hak Baek, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 504 days.

(21) Appl. No.: 12/023,394

(22) Filed: Jan. 31, 2008

(65) Prior Publication Data

US 2008/0238328 A1 Oct. 2, 2008

(30) Foreign Application Priority Data

Mar. 26, 2007 (KR) ..... 10-2007-0029453

(51) Int. Cl.
*G09G 3/30* (2006.01)

(52) U.S. Cl. ..... 315/76; 345/77; 345/82; 315/169.3

(58) Field of Classification Search ..... 315/161, 315/167, 169.3; 345/36, 39, 45–46, 55, 76–78, 345/82, 83, 92

See application file for complete search history.

(56) References Cited

U.S. PATENT DOCUMENTS

| | | | | |
|---|---|---|---|---|
| 7,420,324 | B2 * | 9/2008 | Kim et al. | 313/506 |
| 7,645,631 | B2 * | 1/2010 | Matsunaga | 438/99 |
| 2004/0012336 | A1 * | 1/2004 | Okuda | 315/169.1 |
| 2004/0233140 | A1 * | 11/2004 | Jo | 345/76 |
| 2004/0246209 | A1 * | 12/2004 | Sung | 345/76 |
| 2005/0269941 | A1 * | 12/2005 | Kim et al. | 313/503 |
| 2006/0061291 | A1 * | 3/2006 | Lee et al. | 315/169.3 |
| 2006/0255725 | A1 * | 11/2006 | Kim | 313/506 |
| 2007/0146247 | A1 * | 6/2007 | Huang et al. | 345/76 |
| 2007/0152937 | A1 * | 7/2007 | Jung et al. | 345/92 |

FOREIGN PATENT DOCUMENTS

| | | | |
|---|---|---|---|
| JP | 10-319909 | | 12/1998 |
| JP | 2001-350431 | | 12/2001 |
| KR | 1020040035810 | A | 4/2004 |
| KR | 1020040087692 | A | 10/2004 |
| KR | 20060041252 | | 5/2006 |
| KR | 1020060086857 | A | 8/2006 |

OTHER PUBLICATIONS

Korean office action dated Jul. 14, 2008 in corresponding Korean patent application No. 10-2007-0029453.

* cited by examiner

*Primary Examiner* — Douglas W Owens
*Assistant Examiner* — Tung X Le
(74) *Attorney, Agent, or Firm* — F. Chau & Associates, LLC

(57) ABSTRACT

A light emitting pixel includes a first organic light emitting diode (OLED) and a capacitor supplying to the first OLED current generated by an electric charge corresponding to a difference between a first voltage supplied to a first electrode of the capacitor and a second voltage supplied to a second electrode of the capacitor. The light emitting pixel further include a second OLED to supply the first voltage to the first electrode. The light emitting pixel further includes a voltage supply device to supply the first voltage to the first electrode in response to the second voltage.

6 Claims, 17 Drawing Sheets

LIGHT EMITTING PIXEL AND APPARATUS FOR DRIVING THE SAME

CROSS-REFERENCE TO RELATED PATENT APPLICATION

This application claims the benefit of Korean Patent Application No. 10-2007-0029453, filed on Mar. 26, 2007, in the Korean Intellectual Property Office, the disclosure of which is incorporated herein in its entirety by reference.

BACKGROUND OF THE INVENTION

1. Technical Field

The present disclosure relates to a light emitting display and, more particularly, to the structure of a light emitting pixel and a driving method thereof, and an apparatus and method for driving the light emitting pixel.

2. Discussion of Related Art

Recently, amorphous-Silicon (a-Si) backplane technology or poly-Silicon (poly-Si) backplane technology has been used for an active matrix organic light emitting diode (AMOLED). In the AMOLEDs manufactured using the a-Si as a backplane, thin-film transistors (TFTs) embodied in an AMOLED panel have a problem with stability. Thus, a threshold voltage characteristic of each of the TFTs may vary as time passes. Also, in the AMOLEDs manufactured using the poly-Si or low temperature poly-Si (LTPS) as a backplane, TFTs embodied in an AMOLED panel have a problem with uniformity. Thus, a threshold voltage characteristic of each of the TFTs may change from one another according to the position where each TFT is located.

The change in the threshold voltage characteristic of each TFT embodied in the AMOLED is presented as dirt, referred to by the Japanese term mura, on the AMOLED panel. Thus, the change in the threshold voltage characteristic deteriorates the quality of an image displayed on the AMOLED panel and also shortens the life of the AMOLED panel.

To solve the above problems, the AMOLED is driven in accordance with a digital driving method that will be described hereinbelow. FIG. 1 illustrates the structure of a general organic light emitting pixel. FIG. 2 is a graph showing the characteristics of the voltage and current of the driving TFT of FIG. 1.

Referring to FIGS. 1 and 2, an organic light emitting pixel 10 includes a switching TFT 11, a storage capacitor 12, a driving TFT 13, and an organic light emitting diode (OLED) 14. The switching TFT 11 outputs a data signal input through a data line DL, or signal line, to the storage capacitor 12 in response to a scan signal input through a scan line SL. The storage capacitor 12 receives the data signal output from the switching TFT 11 and stores the received data signal.

The driving TFT 13 is turned on/off based on the voltage level of the data signal stored in the storage capacitor 12. When the driving TFT 13 is turned on, the driving TFT 13 supplies a voltage, or current, supplied from a voltage supply line to the OLED 14. Thus, the OLED 14 emits light in response to the supplied voltage or current.

As shown in FIG. 2, even when the characteristics of a voltage Vsignal and current $I_{OLED}$ of the driving TFT 13 vary according to position or time, if the AMOLED is driven in accordance with the digital driving method, the driving TFT 13 is simply used as a switch, so that there is not much change in the amount of current flowing to the OLED 14.

FIG. 3 illustrates a conventional digital driving method. For the convenience of explanation, FIG. 3 illustrates an example of the digital driving method to embody a total of sixteen gray values, in which a frame includes four sub-frames Sub-frame1 through Sub-frame4. In this example, the frame is referred to as a field and the sub-frame is referred to as a sub-field.

As shown in FIG. 3, a data signal used simply to turn on/off the driving TFT 13 at each sub-frame Sub-frame1 through Sub-frame4 is stored in the storage capacitor 12 shown in FIG. 1. Also, the gray value or gradation of the OLED 14 at each sub-frame Sub-frame1 through Sub-frame4 is presented as an integration value of the current supplied to the OLED 14 through the driving TFT 13 that is turned on.

For example, the OLED at a first row emits light for 8T during the first sub-frame Sub-frame1, for a time 4T during the second sub-frame Sub-frame2, for a time 2T during the third sub-frame Sub-frame3, and for a time 1T during the fourth sub-frame Sub-frame4. In this example, the time T indicates the time during which the driving TFT 13 is turned on. Thus, the OLED at the first row can present value Gray 16.

The OLED at the second row that does not emit light during the first through fourth sub-frames Sub-frame1 through Sub-frame 4 can present value Gray 0. Also, the OLED at the third row that emits light only during the third and fourth sub-frames Sub-frame3 and Sub-frame 4 can present value Gray 4. The OLED at the fourth row that emits light only during the first, third, and fourth sub-frames Sub-frame1, Sub-frame3, and Sub-frame 4 can present value Gray 12.

As shown in FIG. 3, when one frame is formed of four sub-frames, due to the characteristic of a digital driving method, the driving TFT 13 needs to supply a large amount of current at a fast frequency to the OLED 14 during a single frame. For example, the driving TFT 13 at the first row supplies a large amount of current to the OLED 14 four times and the driving TFT 13 at the fourth row supplies a large amount of current to the OLED 14 three times.

When a single frame is formed of n number of sub-frames, where n is a natural number, the driving TFT 13 needs to supply a large amount of current to the OLED 14 a maximum n times due to the characteristic of the digital driving method. Thus, as lots of stress is applied to the OLED 14, the function of the OLED 14 is rapidly degraded and a change in the amount of current flowing in the OLED 14 occurs as time passes. Thus, the change in the amount of current reduces the brightness of the AMOLED panel including the organic light emitting pixel 10 and shortens the life of the AMOLED.

Therefore, the structure of a light emitting pixel that is completely independent of the deviation of each of the driving TFTs embodied in the AMOLED panel and that can supply a constant amount of current to the OLED regardless of the deterioration of the function of the OLED that is generated as time passes, and a method for driving the light emitting pixel, are needed.

SUMMARY OF THE INVENTION

To solve the above and/or other problems, exemplary embodiments of the present invention provide a structure of a light emitting pixel that has a uniform output regardless of a change in the characteristic of a driving TFT embodied in an AMOLED panel, and a method for presenting a gray value of the light emitting pixel.

Exemplary embodiments of the present invention provide an apparatus and method for driving the light emitting pixel. Also, exemplary embodiments of the present invention provide a display apparatus including the light emitting pixel.

According to an exemplary embodiment of the present invention, a light emitting pixel comprises a first OLED (organic light emitting diode) and a capacitor supplying to the first OLED a current generated by an electric charge corresponding to a difference between a first voltage supplied to a first electrode of the capacitor and a second voltage supplied to a second electrode of the capacitor.

The light emitting pixel further comprises a second OLED to supply the first voltage to the first electrode. The light emitting pixel further comprises a voltage supply device to supply the first voltage to the first electrode in response to the second voltage. The first voltage or the second voltage is toggled a predetermined number of times for each light emitting period.

The light emitting pixel further comprises a switching circuit to supply the second voltage to the second electrode by being switched based on a scan signal input through a scan line and a data signal input through a data line.

According to an exemplary embodiment of the present invention, a light emitting pixel comprises a capacitor including a first electrode receiving a first voltage and a second electrode receiving a second voltage and a first OLED (organic light emitting diode) having an anode connected to the first electrode. A cathode of the first OLED is connected to a first power supply supplying a third voltage higher than the first voltage or a second power supply supplying a fourth voltage lower than the third voltage.

The light emitting pixel further comprises a second OLED connected between the first power supply supplying the third voltage higher than the first voltage and the first electrode. The light emitting pixel further comprises a switching device to supply the first voltage to the first electrode in response to the second voltage.

The first voltage or the second voltage is toggled a predetermined number of times for each light emitting period. The light emitting pixel further comprises a switching circuit to supply the second voltage to the second electrode by being switched based on a scan signal input through a scan line and a data signal input through a data line.

According to an exemplary embodiment of the present invention, a voltage generating circuit comprises a control signal generator generating a control signal and a voltage generator generating a first voltage supplied to a first electrode of a capacitor to control the light emission of an OLED (organic light emitting diode) and a second voltage supplied to a second electrode of the capacitor, wherein, to represent a gradation using the OLED, the voltage generator generates a voltage to control the light emission of the OLED generating the first voltage or the second voltage that toggles a predetermined number of times for each light emitting period in response to the control signal.

According to an exemplary embodiment of the present invention, a driver to drive a light emitting pixel comprises an OLED (organic light emitting diode), a capacitor including a first electrode and a second electrode and supplying to the OLED current generated by an electric charge corresponding to a difference between a first voltage supplied to the first electrode and a second voltage supplied to the second electrode, a control signal generator generating a control signal, and a voltage generator generating the first voltage or the second voltage that toggles a predetermined number of times during a light emitting period in response to the control signal to represent a gradation using the OLED.

When the light emitting pixel further comprises a switching circuit to supply the second voltage to the second electrode based on a scan signal input through a scan line and a data signal input through a data line, the driver further comprises a signal generation circuit to generate the scan signal and the data signal in response to at least one timing control signal.

According to an exemplary embodiment of the present invention, a display apparatus comprises a panel including a plurality of data lines, a plurality of scan lines, and a plurality of light emitting pixels, and a driver including a voltage generator generating a second voltage and supplying data signal through the data lines and scan signals through the scan lines, wherein each of the light emitting pixels comprises a capacitor including a first electrode receiving a first voltage and a second electrode receiving the second voltage, a first OLED (organic light emitting diode) having an anode connected to the first electrode, and a switching circuit to supply the second voltage to the second electrode based on a scan signal input through a corresponding one of the scan lines and a data signal input through a corresponding one of the data lines.

Each of the light emitting pixels further comprises a second OLED connected between a power supply and the first electrode. Each of the light emitting pixels further comprises a switching device connected between a power supply and the first electrode and switched in response to the second voltage. A cathode of the first OLED is connected to a first power supply or a second power supply generating a voltage lower than that of the first power supply.

The driver comprises a data line driver including the voltage generator generating the second voltage and supplying the data signals through the data lines and a scan line driver to supply the scan signals through the scan lines.

According to an exemplary embodiment of the present invention, a method for representing a gradation of a light emitting pixel comprises charging an electric charge corresponding to a difference between a first voltage and a second voltage in a capacitor and representing a gradation in response to a current corresponding to the electric charge charged in the capacitor using a first OLED (organic light emitting diode).

The method further comprises supplying to the capacitor the first voltage or the second voltage that toggles a predetermined number of times for each light emitting period.

The method further comprises supplying to the capacitor the first voltage that toggles a predetermined number of times for each light emitting period using a second OLED. The method further comprises supplying to the capacitor the first voltage that toggles a predetermined number of times through a switching device that switches in response to the second voltage for each light emitting period.

The method further comprises supplying to the capacitor the second voltage that toggles a predetermined number of times based on a scan signal input through a scan line and a data signal input through a data line for each light emitting period.

According to an exemplary embodiment of the present invention, a method for driving a light emitting pixel comprises supplying a first voltage to a first electrode of a capacitor that is capable of controlling light emission of an OLED (organic light emission diode) and a second voltage to a second electrode of the capacitor and toggling the first voltage and the second voltage a predetermined number of times for each light emitting section.

According to an exemplary embodiment of the present invention, a light emitting pixel comprises a first OLED (organic light emitting diode) connected between a first power supply to supply a first voltage and a first electrode of a capacitor, a second OLED connected between the first electrode and a second power supply, and a switching circuit switched based on a scan signal input through a scan line and a data signal input through a data line to supply a second voltage to a second electrode of the capacitor.

According to an exemplary embodiment of the present invention, a light emitting pixel comprises a switching device connected between a first power supply to supply a first voltage and a first electrode of a capacitor and switched in response to a second voltage, a second OLED (organic light emitting diode) connected between the first electrode and a second power supply, and a switching circuit switched based on a scan signal input through a scan line and a data signal input through a data line to supply the second voltage to a second electrode of the capacitor. The second power supply supplies a voltage lower than the first voltage.

According to an exemplary embodiment of the present invention, a light emitting pixel comprises a first OLED (organic light emitting diode) connected between a first power supply to supply a first voltage and a first electrode of a capacitor, a second OLED connected between the first electrode and a second power supply, and a switching circuit switched based on a scan signal input through a scan line and a data signal input through a data line to supply a second voltage to a second electrode of the capacitor.

According to an exemplary embodiment of the present invention, a light emitting pixel comprises a switching device connected between a first power supply to supply a first voltage and a first electrode of a capacitor and switched in response to a second voltage, a second OLED (organic light emitting diode) connected between the first power supply and the first electrode, and a switching circuit switched based on a scan signal input through a scan line and a data signal input through a data line to supply the second voltage to a second electrode of the capacitor. The first voltage or the second voltage is toggled a predetermined number of times for each light emitting period.

BRIEF DESCRIPTION OF THE DRAWINGS

Exemplary embodiments of the present invention will be understood in more detail from the following descriptions taken in conjunction with the attached drawings, in which.

DETAILED DESCRIPTION OF EXEMPLARY EMBODIMENTS

Figure 1:
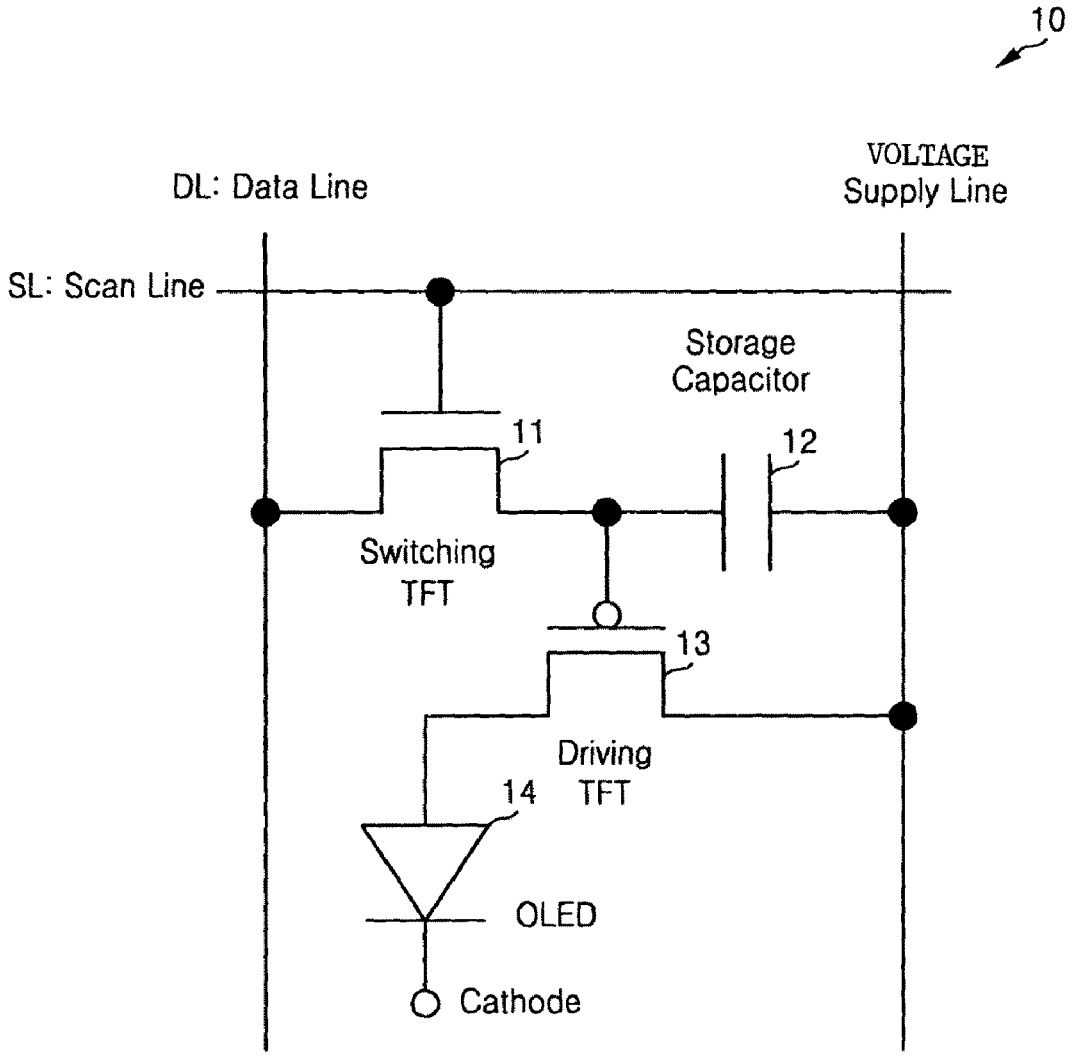
FIG. 1 (PRIOR ART)
FIG. 1 illustrates the structure of a general, previously known, organic light emitting pixel.
Figure 2:
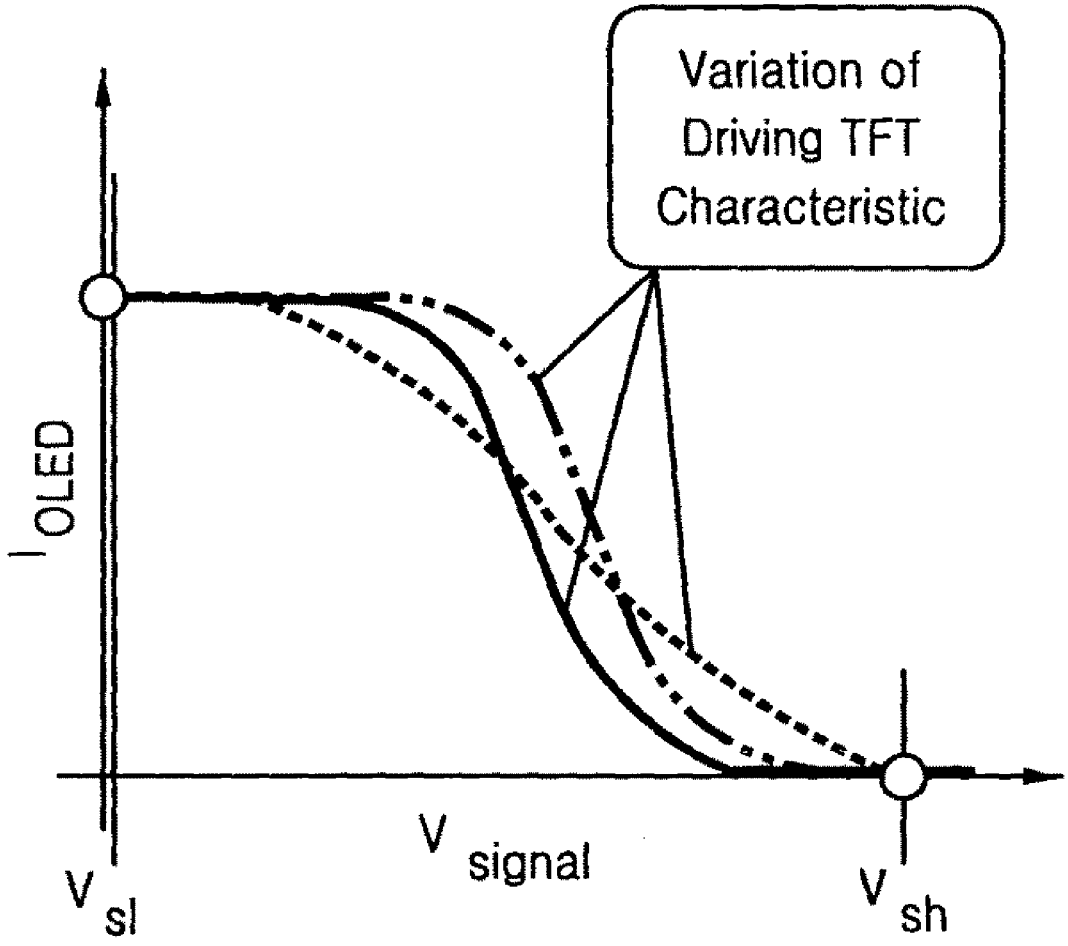
FIG. 2 is a graph showing the characteristics of the voltage and current of the driving TFT of FIG. 1.
Figure 3:
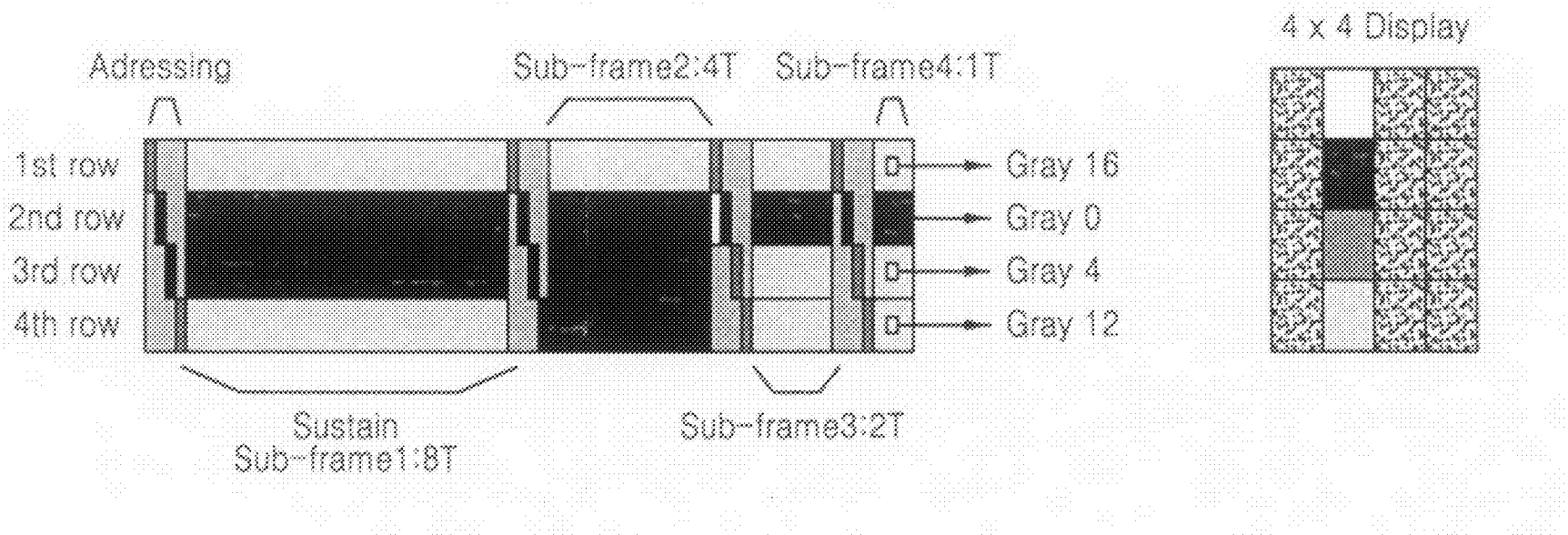
FIG. 3 (PRIOR ART)
FIG. 3 illustrates a conventional, previously known, digital driving method.

The attached drawings for illustrating exemplary embodiments of the present invention are referred to in order to gain a sufficient understanding of the present invention, the merits thereof, and the objectives accomplished by the implementation of the present invention. Hereinafter, the present invention will be described in detail by explaining exemplary embodiments of the invention with reference to the attached drawings. Like reference numerals in the drawings denote like elements.

Figure 4:
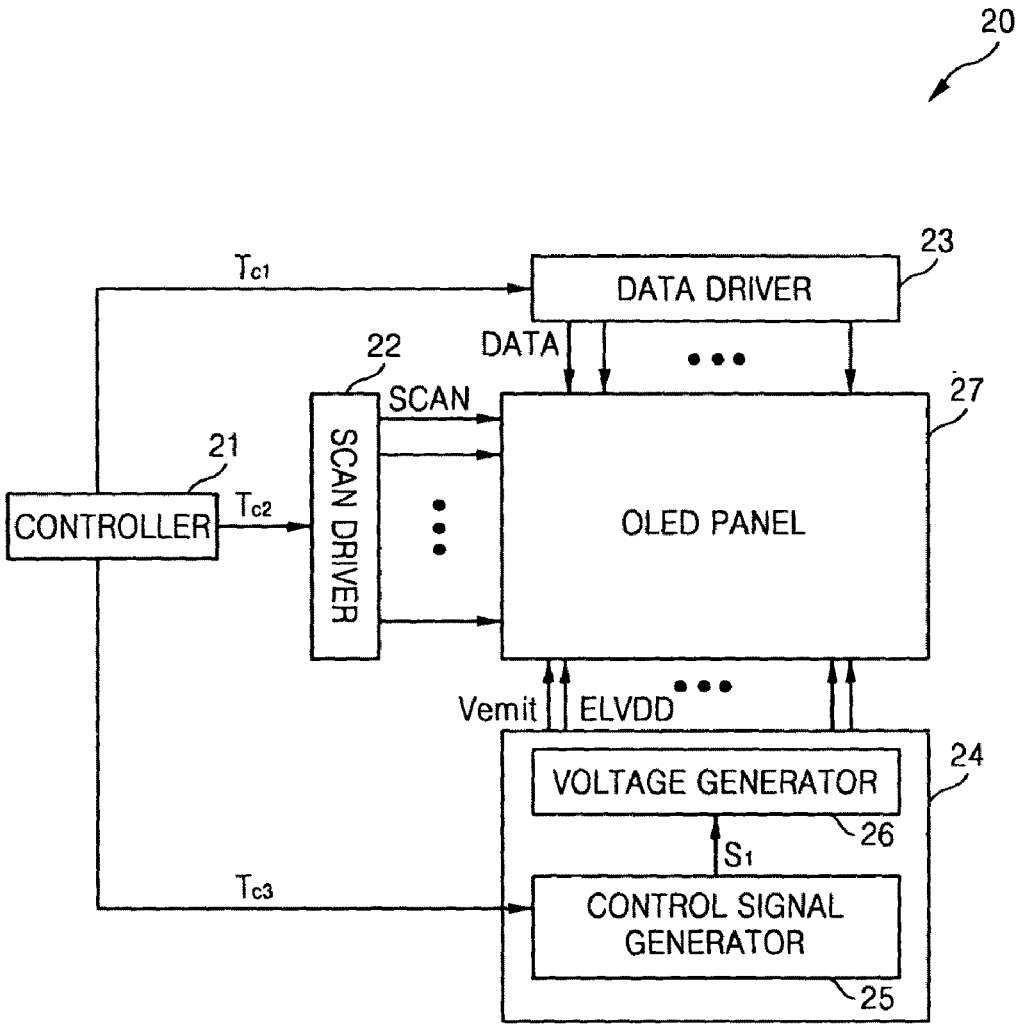
FIG. 4 is a block diagram of a display apparatus according to an exemplary embodiment of the present invention.

FIG. 4 is a block diagram of a display apparatus according to an exemplary embodiment of the present invention. Referring to FIG. 4, a display apparatus 20 according to an exemplary embodiment of the present invention includes a controller 21, a scan driver 22, a data driver 23, a voltage generation circuit 24, and an AMOLED panel 27. Although in FIG. 4 the voltage generation circuit 24 is shown as a circuit separated from the data driver 23, the voltage generation circuit 24 can be embodied in the controller 21, the scan driver 22, or the data driver 23 according to a variety of exemplary embodiments of the present invention.

The AMOLED panel 27 includes a plurality of data lines, a plurality of scan lines, and a plurality of light emitting pixels. Each of the light emitting pixels can be embodied by each of light emitting pixels 100, 200, 300, and 400 respectively shown in FIGS. 5, 10, 12, and 15. The controller 21 outputs a corresponding one of first, second, and third timing control signals Tc1, Tc2, and Tc3 to control the operational timing of the display apparatus 20 to a corresponding one of the scan driver 22, the data driver 23, and a control signal generator 25.

The scan driver 22 in response to the second timing control signal Tc2 supplies a corresponding one of a plurality of scan signals SCAN through a corresponding one of the scan lines. The data driver 23 in response to the first timing control signal Tc1 supplies a corresponding data signal DATA of a plurality of data signals through a corresponding one of the data lines. At least one of the controller 21, the scan driver 22, and the data driver 23 can be embodied into a single chip.

The voltage generation circuit 24 includes the control signal generator 25 and a voltage generator 26. The control signal generator 25 in response to the third timing control signal Tc3 generates at least one control signal S1 to control the voltage generator 26.

The voltage generator 26 in response to the control signal S1 generates at least one of a first voltage ELVDD and a second voltage Vemit. The first voltage ELVDD and the second voltage Vemit are toggled in different numbers for each light emitting period in response to the control signal S1.

The scan driver 22, the data driver 23, and the voltage generation circuit 24 can be embodied into a single circuit or chip. The AMOLED panel 27 is operated based on each of the scan signals SCAN and the data signals DATA and causes each light emitting pixel to emit light in a corresponding one of the gray values based on at least one of the first voltage ELVDD and the second voltage Vemit output from the voltage generation circuit 24.

Figure 5:
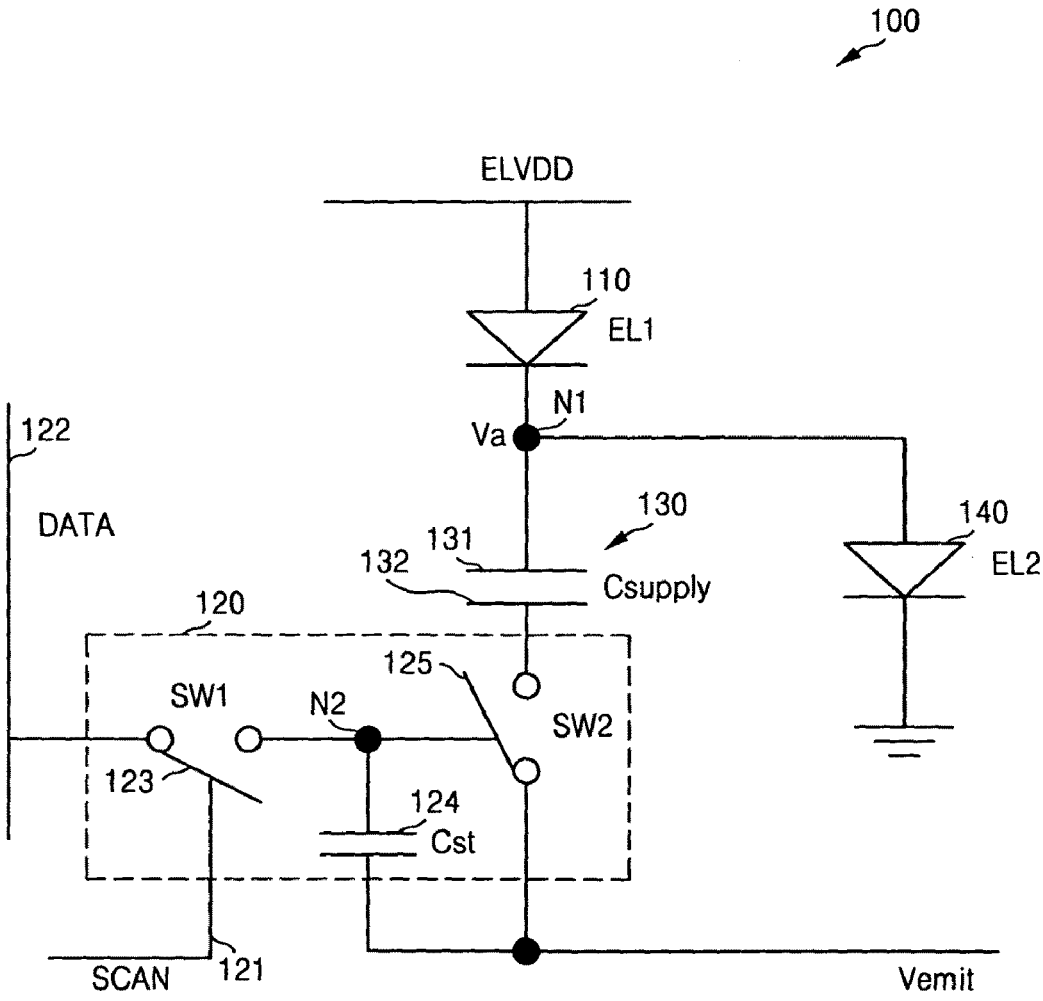
FIG. 5 is the structure of a light emitting pixel according to an exemplary embodiment of the present invention.

FIG. 5 is the structure of a light emitting pixel 100 according to an exemplary embodiment of the present invention. Referring to FIG. 5, the light emitting pixel 100 includes a first OLED 110 (EL1), a switching circuit 120, a first capacitor 130 (C supply) including a first electrode 131 and a second electrode 132, and a second OLED 140 (EL2). The first capacitor 130 performs a function as a current source to supply current to the second OLED 140.

The first OLED 110 is connected between a first power supply line ELVDD and a first electrode 131 of the first capacitor 130 and supplies a first voltage Va to the first electrode 131 through a first node N1. The voltage ELVDD of the first power line is higher than the first voltage Va.

The switching circuit 120 is switched based on the scan signal SCAN input through the scan line 121 and the data signal DATA input through the data line 122 and supplies the second voltage Vemit from a second power supply line to the second electrode 132 of the first capacitor 130. In the operation of the switching circuit 120, the switching circuit 120 includes a first switch 123 (SW1), a second capacitor 124 (Cst), and a second switch 125 (SWZ). The first switch 123 in response to the scan signal SCAN controls the output of the data signal DATA to a second node N2.

The second capacitor 124 stores a predetermined amount of electric charges based on the data signal DATA output from the first switch 123, for example, a high level (data "1") or a low level (data "0"). Thus, the second node N2 has a predetermined electric potential according to the electric charges stored in the second capacitor 124.

The second switch 125 performs a switching operation based on the electric potential of the second node N2 and supplies the second voltage Vemit to the second electrode 132 of the first capacitor 130 according to the switching operation. For example, when the first switch 123 and the second switch 125 are embodied by PMOS transistors, if the first switch 123 supplies the data signal DATA having a low level to the second node N2 in response to the scan signal SCAN having a low level, the second switch 125 supplies the second voltage Vemit to the second electrode 132 of the first capacitor 130. When the first switch 123 and the second switch 125 are embodied by NMOS transistors, however, if the first switch 123 supplies the data signal DATA having a high level to the second node N2 in response to the scan signal SCAN having a high level, the second switch 125 supplies the second voltage Vemit to the second electrode 132 of the first capacitor 130.

Thus, the first capacitor 130 outputs to the second OLED 140 a current generated by an electric charge corresponding to a difference between the first voltage Va supplied to the first electrode 131 and the second voltage Vemit supplied to the second electrode 132. The second OLED 140 is connected between the first electrode 131 of the first capacitor 130 and a second power supply and emits light by the current supplied by the first capacitor 130. The second power supply supplies a voltage lower than the voltage ELVDD of the first power line and supplies a ground voltage or a common voltage supplied to the AMOLED panel 27 shown in FIG. 4.

Figure 8:
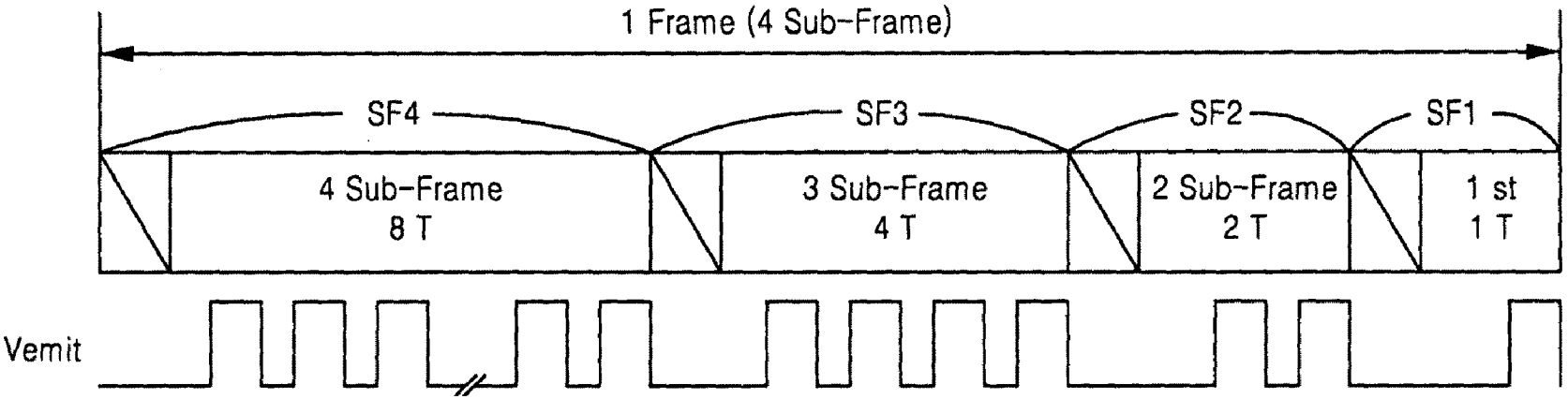
FIG. 8 is a timing diagram showing an example of driving the light emitting pixel of FIG. 6 in a light emitting period.

Because the voltage ELVDD of the first power line and the second voltage Vemit are toggled in different numbers in a light emitting period of different sub-frames as shown in FIG. 8, the light emitting pixel 100 emits light in response to the current supplied from the first capacitor 130 in the light emitting period, so that the light emitting pixel 100 represents a gradation.

Figure 6:
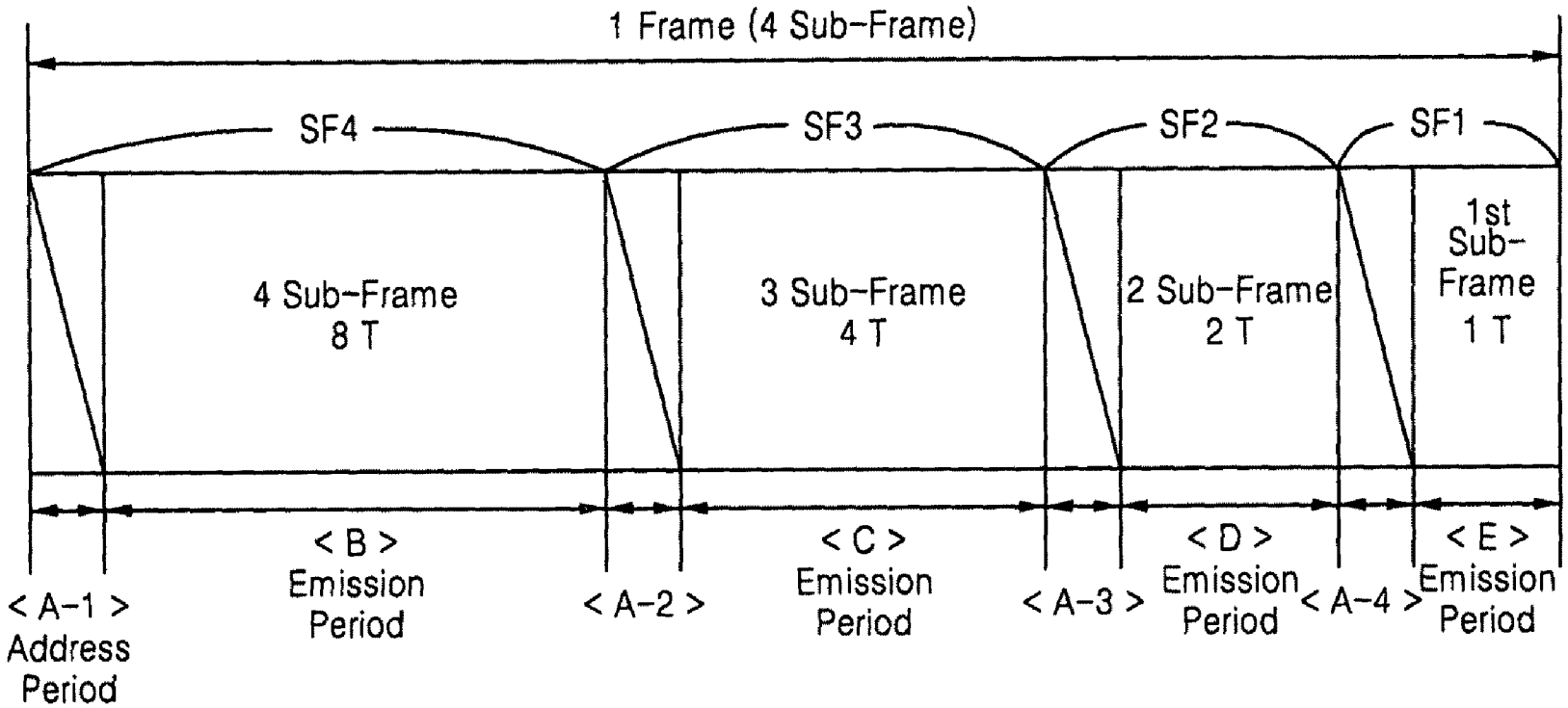
FIG. 6 is a timing diagram showing an example of a frame to drive the light emitting pixel of FIG. 5.

FIG. 6 is a timing diagram showing an example of a frame used to drive the light emitting pixel of FIG. 5. Referring to FIG. 6, a single frame can be formed of a plurality of sub-frames. For the convenience of explanation, FIG. 6 illustrates a frame including four sub-frames SF1, SF2, SF3, and SF4 to represent a total of sixteen gray values. The four sub-frames SF1, SF2, SF3, and SF4 respectively include address periods A-4, A-3, A-2, and A-1 and light emitting periods E, D, C, and B.

Figure 7:
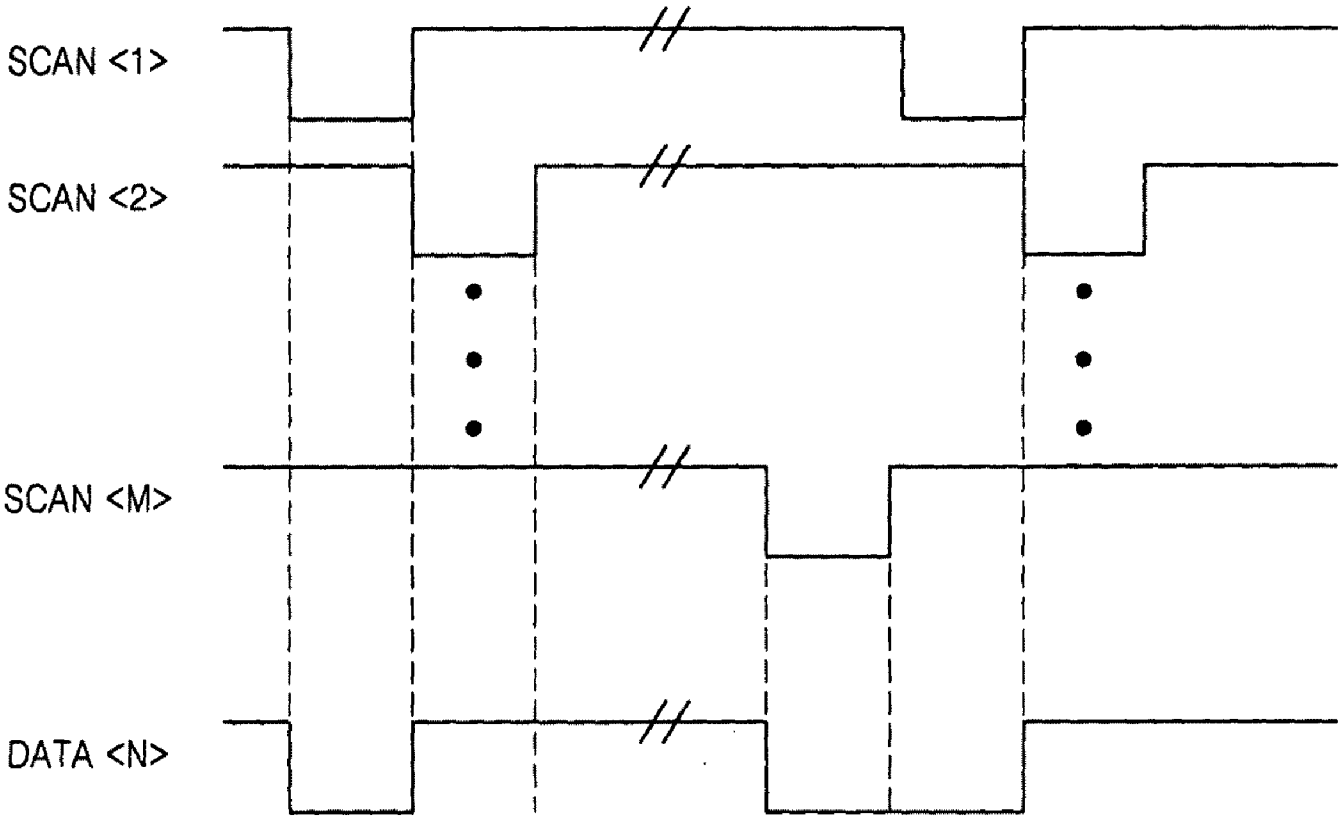
FIG. 7 is a timing diagram showing an example of the address period of FIG. 6.

FIG. 7 is a timing diagram showing an example of the address period as shown in FIG. 6. Referring to FIGS. 5, 6, and 7, during each of the address periods A-4, A-3, A-2, and A-1, the scan driver 22 in response to the second timing control signal Tc2 sequentially selects the scan lines and outputs corresponding scan signals SCAN<1>, SCAN<2>, . . . , SCAN<M>, and SCAN<N> having a low level to the sequentially selected scan line. In this exemplary embodiment, M and N are natural numbers and N>M.

Referring back to FIG. 5, when the scan signal SCAN input through the selected scan line 121 has a low level, the first switch 123 (SW1) embodied by a PMOS transistor is turned on. Thus, the data signal DATA input through the data line 122 is stored in or written to the second capacitor 124. The second node N2 has a particular electric potential according to the level of the data signal DATA stored in the second capacitor 124.

The second switch 125 (SW2) embodied by the PMOS transistor is turned on or off according to a particular electric potential of the second node N2. When the data signal DATA has a low level or data "0", the second switch 125 turned on in response to the data signal DATA having a low level supplies the second voltage Vemit to the second electrode 132 of the first capacitor 130.

During each of the address periods A-4, A-3, A-2, and A-1, corresponding data is written to the light emitting pixels forming the AMOLED panel 27, and each of the light emitting pixels emits light during each of the light emitting periods E, D, C, and B based on the data written during each of the address periods A-4, A-3, A-2, and A-1. That is, each of the light emitting pixels forming the AMOLED panel 27 represents a gray value in response to the second voltage Vemit that toggles a predetermined number of times during each of the light emitting periods E, D, C, and B.

FIG. 8 is a timing diagram showing an example of driving the light emitting pixel of FIG. 6 in a light emitting period. Referring to FIGS. 5 through 8, during each of the address periods A-4, A-3, A-2, and A-1 of the sub-frames SF1, SF2, SF3, and SF4, each of the data signals is input to each of the light emitting pixels included in the AMOLED panel 27 in response to each of the scan signals SCAN<1>, SCAN<2>, . . . , SCAN<M>, and SCAN<N>. Then, each of the light emitting pixels emits light during each of the light emitting periods E, D, C, and B in response to a corresponding one of the data signals and the second voltage Vemit toggled in a predetermined number of times. That is, each of the light emitting pixels represents a gray value based on the number of toggling of the second voltage Vemit.

Referring to FIGS. 5 and 8, when the second switch 125 (SW2) is turned on in response to the voltage of the second node N2, the second voltage Vemit is supplied to the second electrode 132 of the first capacitor 130. When the second voltage Vemit of a low level is supplied to the second electrode 132 of the first capacitor 130, the electric charges by the first power is supplied to the first electrode 131 of the first capacitor 130 through the first OLED 110. Accordingly, the voltage Va of the first node N1 increases up to a voltage (Va=ELVDD−Vth_EL1) corresponding to the difference between the voltage ELVDD of the first power line and the threshold voltage Vth_EL1 of the first OLED 110. The voltage (Va=ELVDD−Vth_EL1) must be lower than the threshold voltage Vth_EL2 of the second OLED 140.

When the second voltage Vemit having a high level is supplied to the second electrode 132 of the first capacitor 130, the voltage Va of the first node N1 increases in proportion to the amount of change in the second voltage Vemit. Because the difference in voltage or electric potential between both terminals of the second OLED 140 is generated by the changed voltage Va, the first capacitor 130 supplies current to an anode of the second OLED 140. Thus, the second OLED 140 of the light emitting pixel 100 emits light, and the AMOLED panel 27 including the light emitting pixel 100 emits light.

As described above, because the sum of the amount of current flowing in the second OLED 140 varies according to the number of toggling of the second voltage Vemit, the light emitting pixel 100 represents a gray value according to the toggling number of the second voltage Vemit during the light emitting period.

As shown in FIG. 8, the second voltage Vemit toggles once (1T) during the light emitting period of the first sub-frame SF1, twice (2T) during the light emitting period of the second sub-frame SF2, four times (4T) during the light emitting period of the third sub-frame SF3, and eight times (8T) during the light emitting period of the fourth sub-frame SF4. The toggling number of each of the sub-frames SF1-SF4 during the light emitting period described with reference to FIG. 8 is just an example presented for the convenience of explanation. The toggling number of the second voltage Vemit of each of the sub-frames SF1-SF4 during the light emitting period can be any arbitrary number.

The light emitting pixel 100 according to an exemplary embodiment of the present embodiment can represent a gray value during a frame based on a value obtained by integrating the amount or intensity of light emitted during the light emitting period of each of the sub-frames SF1, SF2, SF3, and SF4 at the frame.

Figure 9:
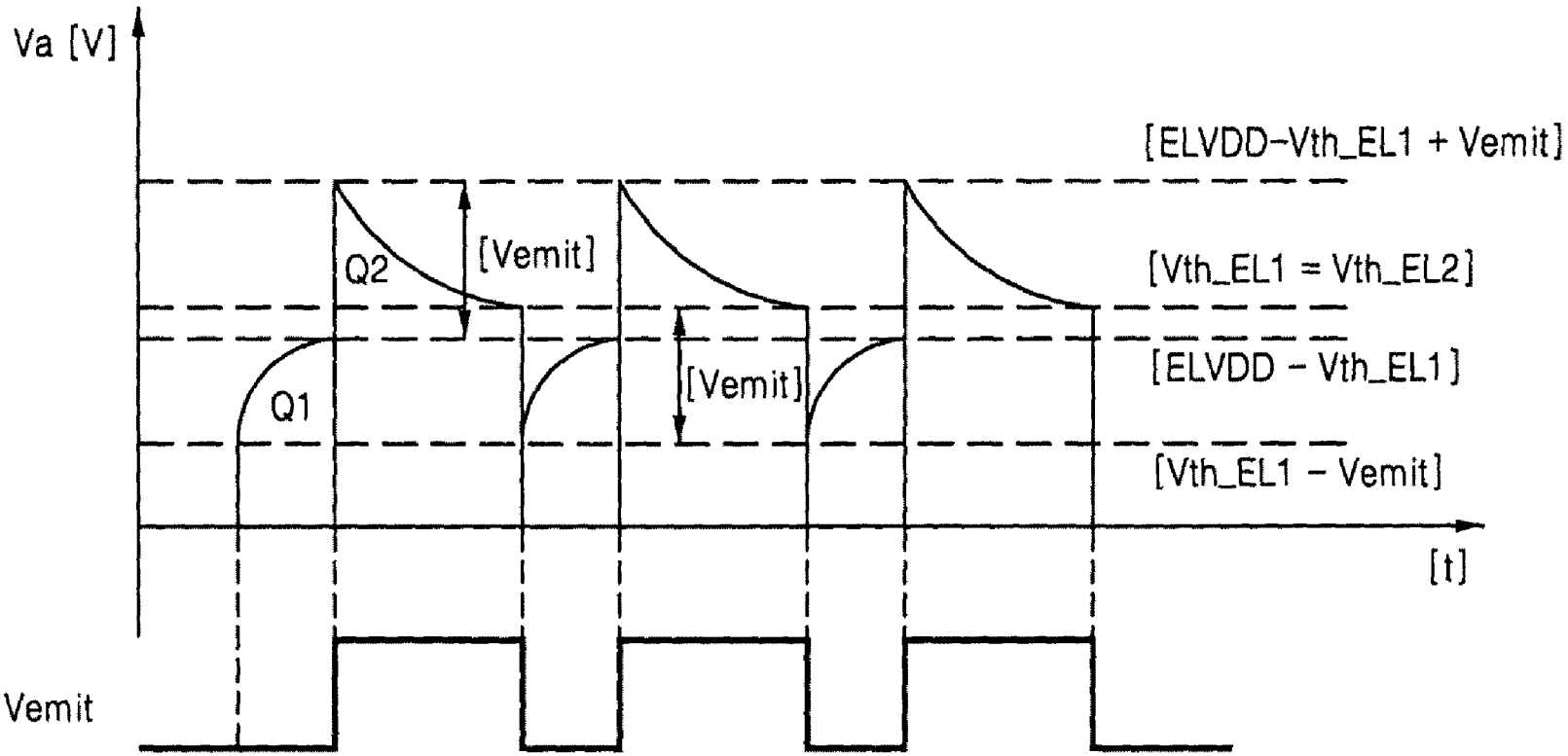
FIG. 9 is a voltage waveform diagram for explaining a method for driving the light emitting pixel of FIG. 5 in a light emitting period.

FIG. 9 is a voltage waveform diagram for explaining a method for driving the light emitting pixel of FIG. 5 in a light emitting period. FIG. 9 shows the change in the voltage Va of the first node N1 and the change in the electric charge of the first capacitor 130 during the light emitting period, for example, light emitting period B, of FIG. 6.

As shown in FIG. 9, the amount of an electric charge Q1 charged in the first capacitor 130 through the first OLED 110 and the amount of an electric charge Q2 discharged from the first capacitor 130 through the second OLED 140 are the same. That is, Q1=Q2.

In the present exemplary embodiment, the light emitting pixel 100 emits light using the electric charge Q1 charged in the first capacitor 130 by toggling the second voltage Vemit or the electric charge Q2 discharged from the second capacitor 130. Also, the light emitting pixel 100 according to the present exemplary embodiment represents a gray value with the sum of the amount of the current flowing in the second OLED 140 according to the toggling number of the second voltage Vemit. Thus, there is an effect of constantly supplying the electric charge Q2 regardless of an external voltage change.

Referring to FIGS. 5 and 9, when the switching circuit 120 is turned on in response to the scan signal SCAN and the data signal DATA, the switching circuit 120 supplies the second voltage Vemit to the second electrode 132 of the first capacitor 130. As described above, the first capacitor 130 charges or discharges based on the level of the second voltage Vemit that toggles. When the second voltage Vemit having the low level is supplied to the second electrode 132 of the first capacitor 130, the electric charge Q1 input through the first OLED 110 is charged in the first capacitor 130.

When the electric charge Q1 is supplied to the first capacitor 130, the voltage Va of the first node N1 increases up to a first level ELVDD−Vth_EL1. Because the first level ELVDD−Vth_EL1 is lower than the threshold voltage Vth_EL2 of the second OLED 140, current does not flow in the second OLED 140. Then, when the level of the second voltage Vemit is toggled or transited to a high level, the voltage Va of the first node N1 increases up to a second level ELVDD−Vth_EL1+Vemit.

Thus, because the first capacitor 13d supplies the electric charge Q2 to the second OLED 140 by the voltage Va of the first node N1 having the second level ELVDD−Vth_EL1+Vemit, the second OLED 140 emits light in response to the current generated by the electric charge Q2.

After the electric charge Q1 charged in the first capacitor 130 is sufficiently discharged, the second voltage Vemit having the high level is toggled or transited to the low level. The voltage Va of the first node N1 decreases down to the threshold voltage Vth_EL1 of the first OLED 110 or the threshold voltage Vth_EL2 of the second OLED 140 just before the second voltage Vemit is toggled from the high level to the low level.

Figure 10:
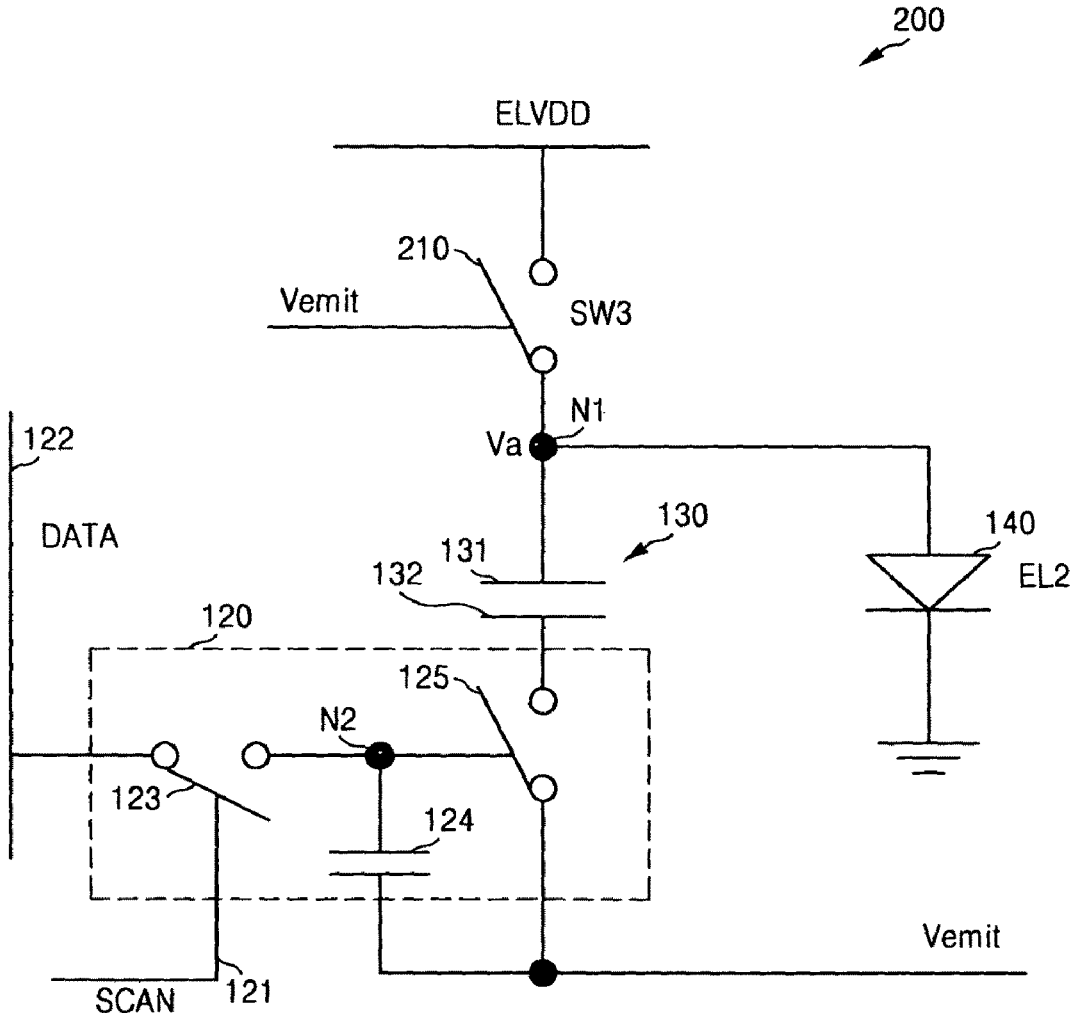
FIG. 10 illustrates the structure of a light emitting pixel according to an exemplary embodiment of the present invention.

FIG. 10 illustrates the structure of a light emitting pixel 200 according to an exemplary embodiment of the present invention. Referring to FIG. 10, the light emitting pixel 200 includes a switching device 210 (SW3), the switching circuit 120, the first capacitor 130 including the first electrode 131 and the second electrode 132, and the second OLED 140. The structure of the light emitting pixel 200 of FIG. 10 is substantially the same as that of the light emitting pixel 100 of FIG. 5, except for the first OLED 110 used in the exemplary embodiment shown in FIG. 5 that is not used in FIG. 10.

The switching device 210 is connected between the first power line ELVDD and the first electrode 131 of the first capacitor 130 and supplies the voltage ELVDD of the first power line to the first node N1 in response to the second voltage Vemit. The switching device 210 can be embodied by a PMOS transistor or an NMOS transistor.

Figure 11:
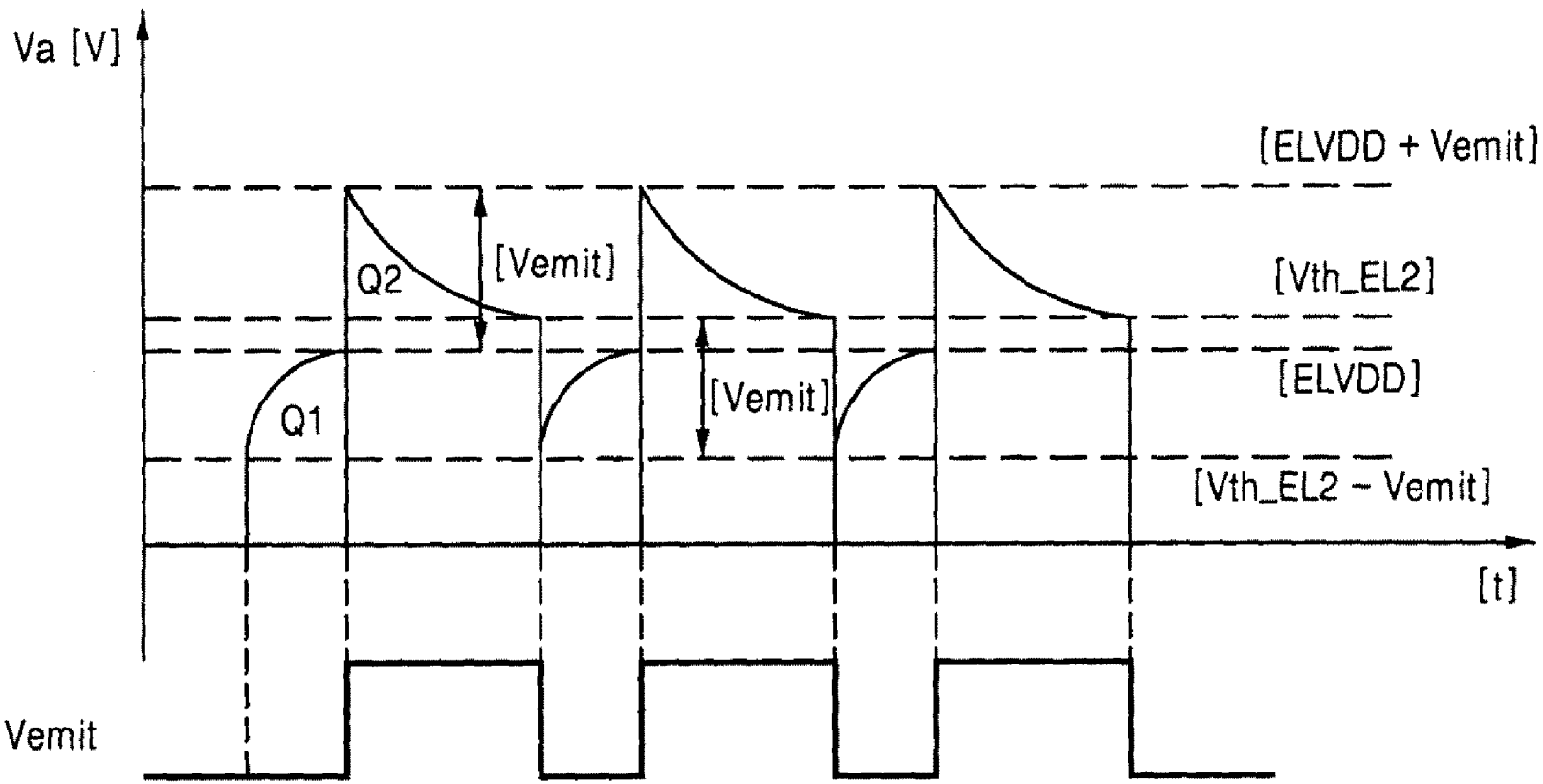
FIG. 11 is a voltage waveform diagram for explaining a method for driving the light emitting pixel of FIG. 10 in a light emitting period.

FIG. 11 is a voltage waveform diagram for explaining a method for driving the light emitting pixel of FIG. 10 in a light emitting period. Referring to FIGS. 10 and 11, in the operation of the light emitting pixel 200 during the light emitting period, when the switching device 210 embodied by the PMOS transistor is turned on in response to the second voltage Vemit having the low level, the first power line supplies the electric charge Q1 to the first capacitor 130. Thus, the first voltage Va of the first node N1 increases up to the first level ELVDD.

Then, the second voltage Vemit is toggled or transited from the low level to the high level. Thus, the switching device 210 embodied by the PMOS transistor is turned off and the first voltage Va of the first node N1 increases up to the second level ELVDD+Vemit.

Thus, because the second level ELVDD_Vemit is higher than the threshold voltage Vth_EL2 of the second OLED 140, the first capacitor 130 supplies the electric charge Q2 to the second OLED 140, and the second OLED 140 emits light in response to the current generated by the electric charge Q2. Because the second voltage Vemit is transited between the low level and the high level a predetermined number of times during the light emitting period, the second OLED 140 can represent a gray value.

The time during which the electric charge Q1 charged in the first capacitor 130 discharges or the second voltage Vemit maintains the high level must be a sufficient time so that the charged electric charge Q1 can be completely discharged. In this case, Q1=Q2. As described above, the light emitting pixel 200 can represent a gray value in response to the second voltage Vemit toggled a predetermined number of times for each light emitting period of the sub-frame.

The principle of driving the light emitting pixel 200 according to the present exemplary embodiment described with reference to FIGS. 10 and 11 is the same as that according to the above-described exemplary embodiment with reference to FIGS. 5 through 8.

Figure 12:
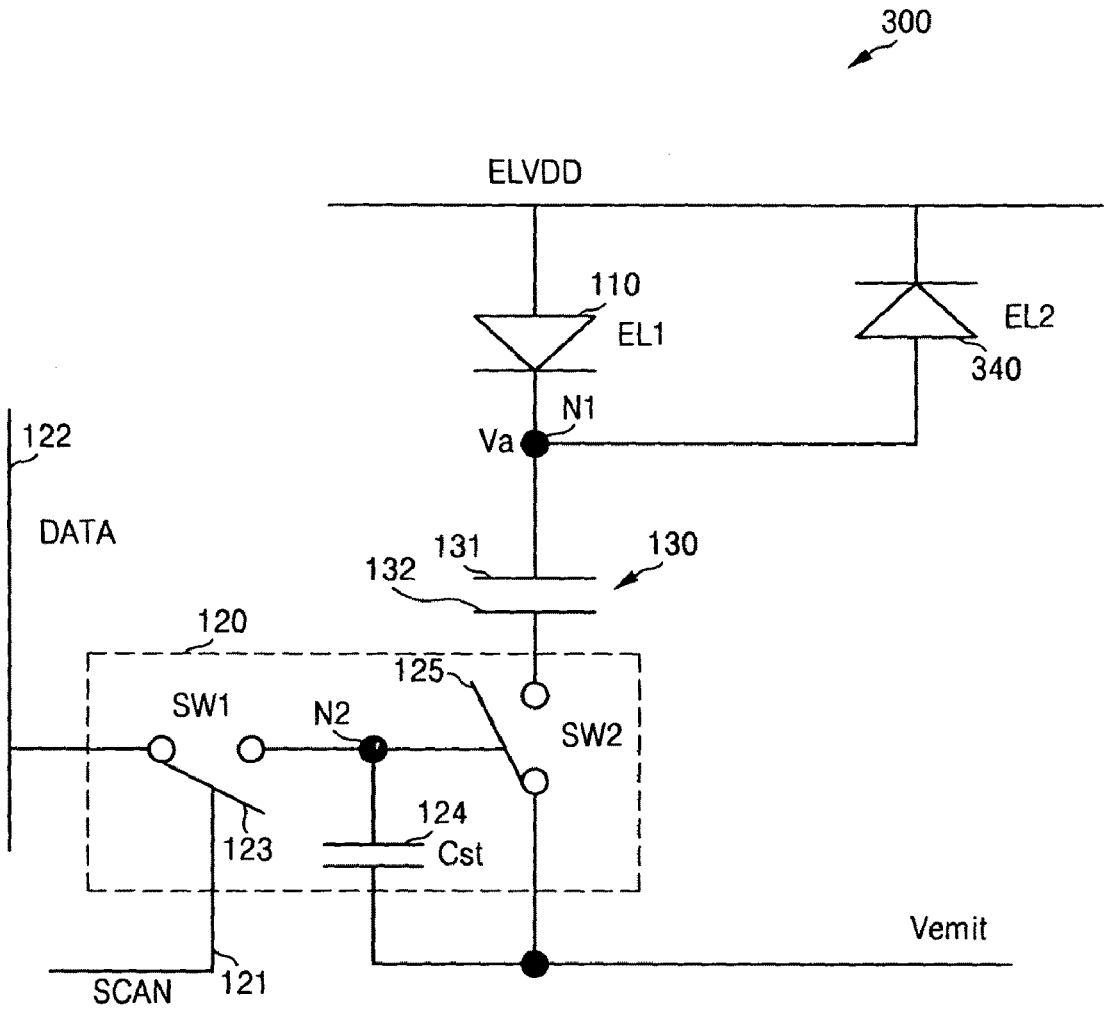
FIG. 12 illustrates the structure of a light emitting pixel according to an exemplary embodiment of the present invention.

FIG. 12 illustrates the structure of a light emitting pixel 300 according to an exemplary embodiment of the present invention. The structure of the light emitting pixel 300 of FIG. 12 is the same as that of the light emitting pixel 100 of FIG. 5 except for the provision of a second OLED 340 (EL2). The second OLED 340 (EL2) is connected between the first node N1 and the first power line supplying the voltage ELVDD. That is, an anode of the second OLED 340 is connected to the first node N1 and a cathode of the second OLED 340 is connected to the first power line ELVDD. Because the light emitting pixel 300 can use the anode of the first OLED 110 and the cathode of the second OLED 340 as the same electrode, the wiring of the light emitting pixel 300 is simplified, so that a numerical aperture can be increased. The light emitting pixel 300 can represent a gray value in response to the second voltage Vemit that toggles a predetermined number of times during the light emitting period of each of the sub-frames of a frame.

Figure 13:
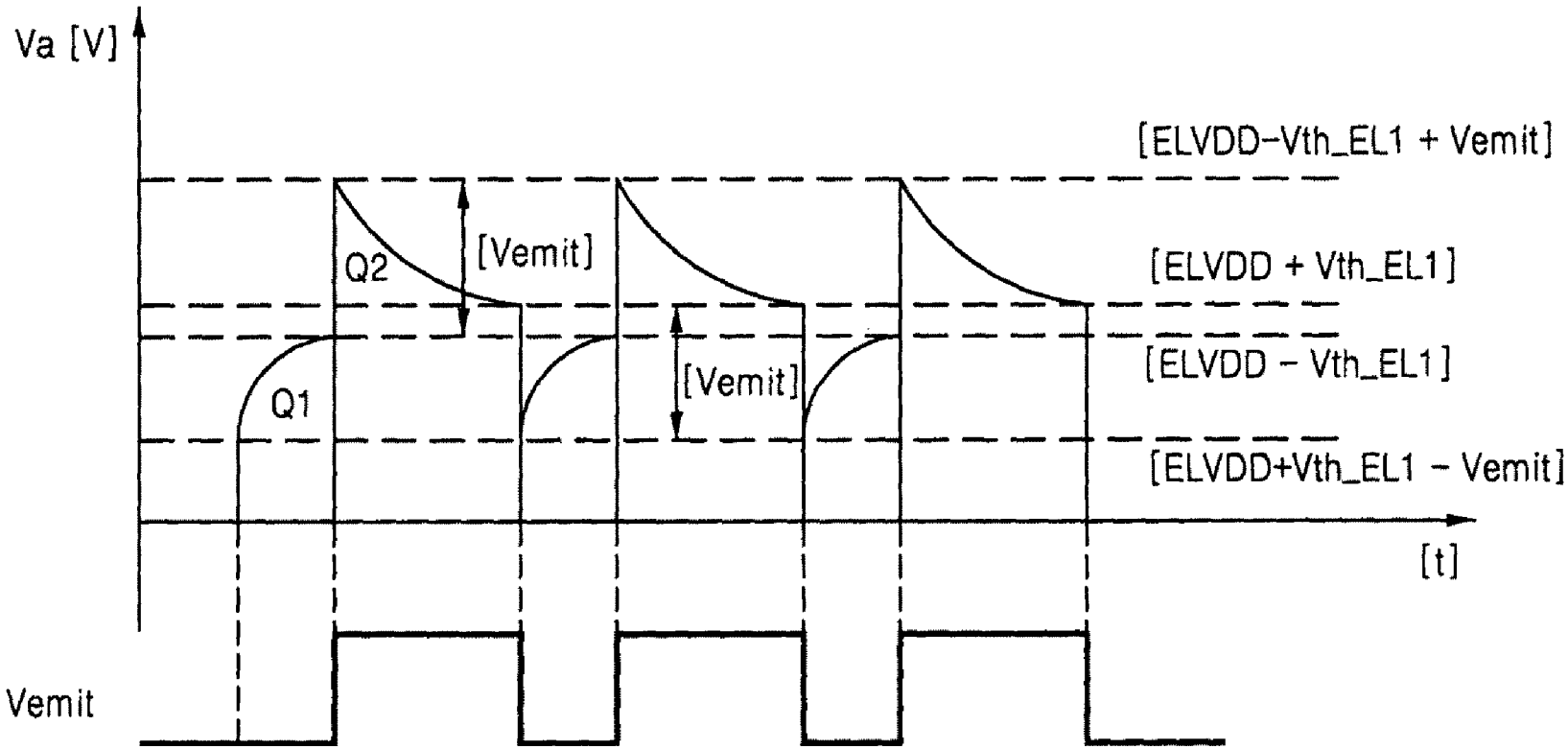
FIG. 13 is a voltage waveform diagram for explaining an exemplary embodiment of the present invention of a method for driving the light emitting pixel of FIG. 12 in a light emitting period.

FIG. 13 is a voltage waveform diagram for explaining an exemplary embodiment of a method for driving the light emitting pixel of FIG. 12 during a light emitting period. FIG. 13 shows the change in the level of the voltage Va of the first node N1 and the movement of the electric charge when the voltage ELVDD of the first power line has a constant level and the second voltage Vemit is toggled between the low level and the high level a predetermined number of times.

Referring to FIGS. 12 and 13, when the switching circuit 120 is turned on in response to the scan data SCAN and the data signal DATA, the switching circuit 120 supplies the second voltage Vemit to the second electrode 132 of the first capacitor 130.

When the second voltage Vemit having the low level is supplied to the second electrode 132 of the first capacitor 130, the electric charge Q1 supplied through the first OLED 310 is charged in the first capacitor 130. Thus, the voltage Va of the first node N1 increases up to the first level ELVDD−Vth_EL1. Because the first level ELVDD−Vth_EL1 is lower than the threshold voltage Vth_EL2 of the second OLED 340, current does not flow in the second OLED 340.

When the second voltage Vemit is toggled or transited from the low level to the high level, the voltage Va of the first node N1 increases up to the second level ELVDD−Vth_EL1+Vemit. Thus, because the second level ELVDD−Vth_EL1+Vemit increases higher than the threshold voltage of the second OLED 340, a difference in the electric potential between both terminals of the second OLED 340 is generated.

Thus, because the first capacitor 130 discharges the charged electric charge Q1 through the second OLED 340, the second OLED 340 emits light in response to the current generated based on the electric charge Q2 that is discharged.

Figure 14:
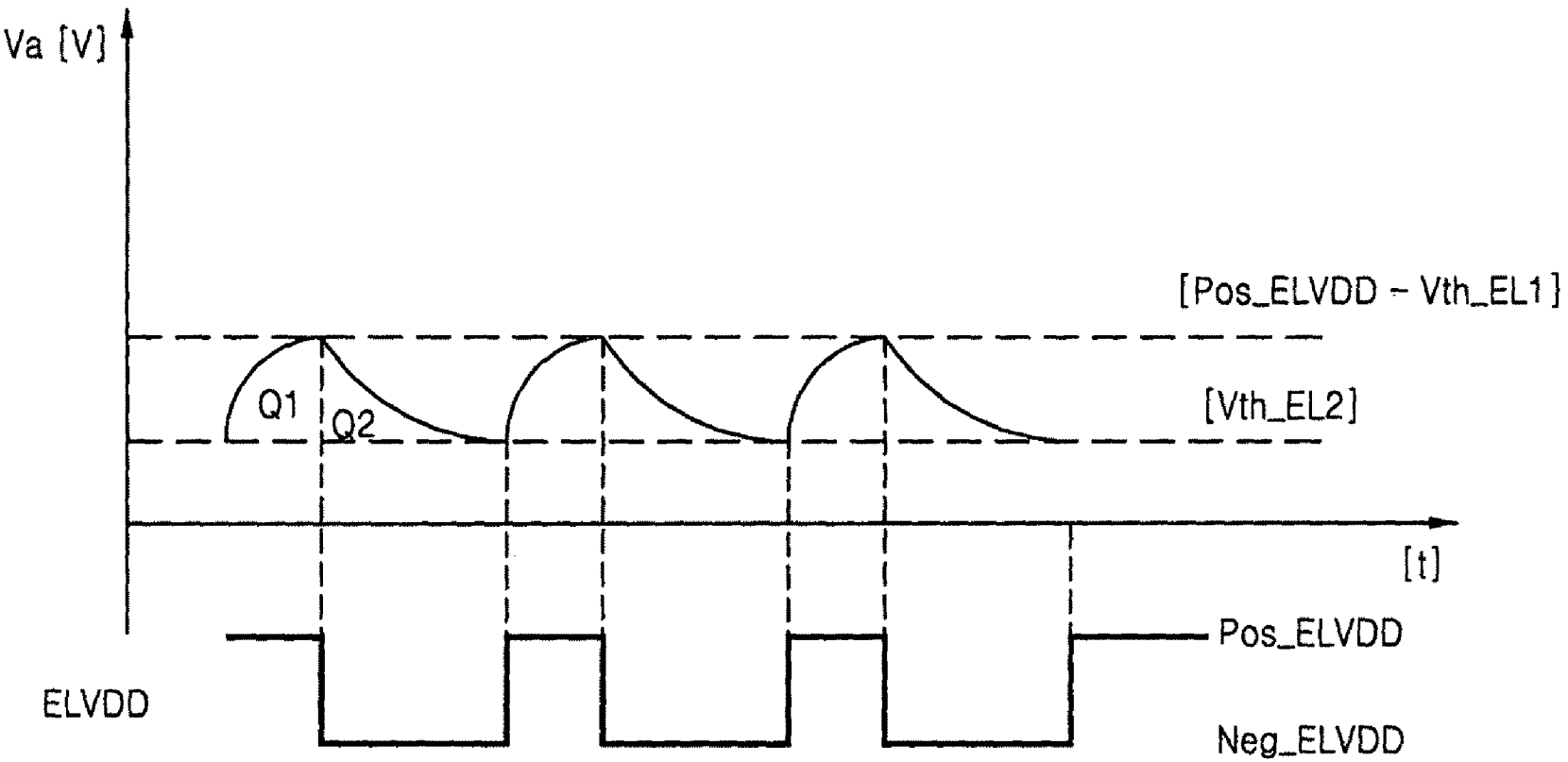
FIG. 14 is a voltage waveform diagram for explaining an exemplary embodiment of the method for driving the light emitting pixel of FIG. 12 in a light emitting period.

FIG. 14 is a voltage waveform diagram for explaining an exemplary embodiment of the method for driving the light emitting pixel of FIG. 12 during a light emitting period. FIG. 14 shows the change in the level of the voltage Va of the first node N1 and the movement of the electric charge when the second voltage Vemit has a constant low level, and the voltage ELVDD of the first power swings between a third level Neg_ELVDD and a fourth level Pos_ELVDD a predetermined number of times. In this exemplary embodiment, the fourth level Pos_ELVDD is higher than the third level Neg_ELVDD.

As shown in FIG. 14, when the voltage ELVDD of the first power line has the fourth level Pos_ELVDD, the first power line supplies the electric charge Q1 to the first capacitor 130 through the first OLED 110 until the voltage Va of the first node N1 increases to a first level Pos_ELVDD−Vth_EL1.

Because the threshold voltage Vth_EL1 of the first OLED 110 and the threshold voltage Vth_EL2 of the second OLED 340 are the same and the voltage ELVDD of the first power line to which the cathode of the second OLED 340 is connected is higher than the first level Pos_ELVDD−Vth_EL1, the second OLED 340 (EL2) does not emit light.

Then, when the voltage ELVDD of the first power line is transited to the third level Neg_ELVDD, the voltage ELVDD of the first power line to which the cathode of the second OLED 340 is connected is lower than the voltage Va of the first node N1. As a result, a difference in the voltage between the anode and cathode of the second OLED 340 is generated so that the electric charge Q1 charged in the first capacitor 130 is discharged through the second OLED 340. Thus, the second OLED 340 emits light based on the electric charge Q2 discharged from the first capacitor 130. In this exemplary embodiment, the time for maintaining the third level Neg_ELVDD must be a long enough time for sufficiently discharging the electric charge Q1 charged in the first capacitor 130 and in this example Q1=Q2.

Because the voltage ELVDD of the first power line is toggled or swings a predetermined number of times during the light emitting period of each of the sub-frames of a frame, the amount of current supplied to the second OLED 340 of the light emitting pixel 300 varies according to the toggling number of the voltage ELVDD of the first power line. Thus, the light emitting pixel 300 can represent a gray value by integrating the amount of light emitted a predetermined number of times for each light emitting period. The first capacitor 130 is advantageous in always supplying a constant amount of electric charge to the second OLED 340 regardless of an external change.

Figure 15:
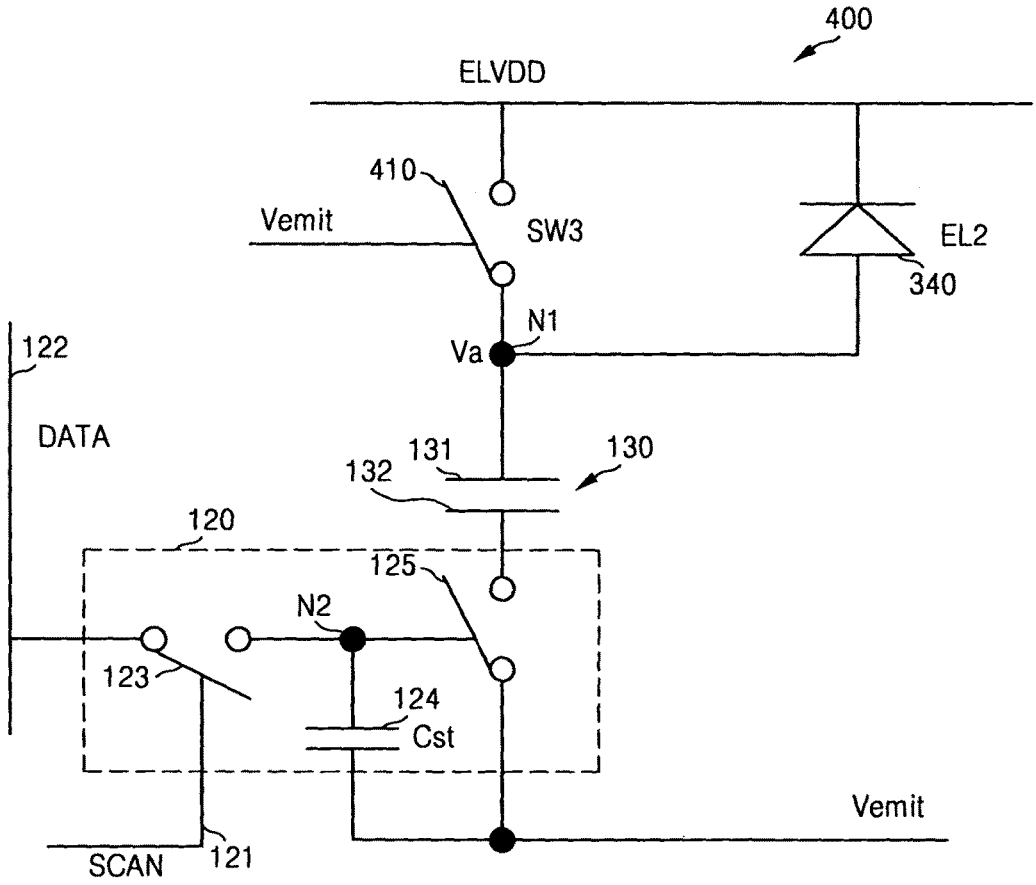
FIG. 15 illustrates the structure of a light emitting pixel according to an exemplary embodiment of the present invention.

FIG. 15 illustrates the structure of a light emitting pixel according to an exemplary embodiment of the present invention. The structure of the light emitting pixel 400 of FIG. 15 is substantially the same as that of the light emitting pixel 300 of FIG. 12 except for the provision of a switching device 410 in FIG. 15.

The switching device 410 (SW3) is connected between the first power line and the first electrode 131 of the first capacitor 130 and turns the first power ELVDD and the first electrode 131 on/off in response to the second voltage Vemit. The switching device 410 can be embodied by a PMOS transistor or an NMOS transistor.

Figure 16:
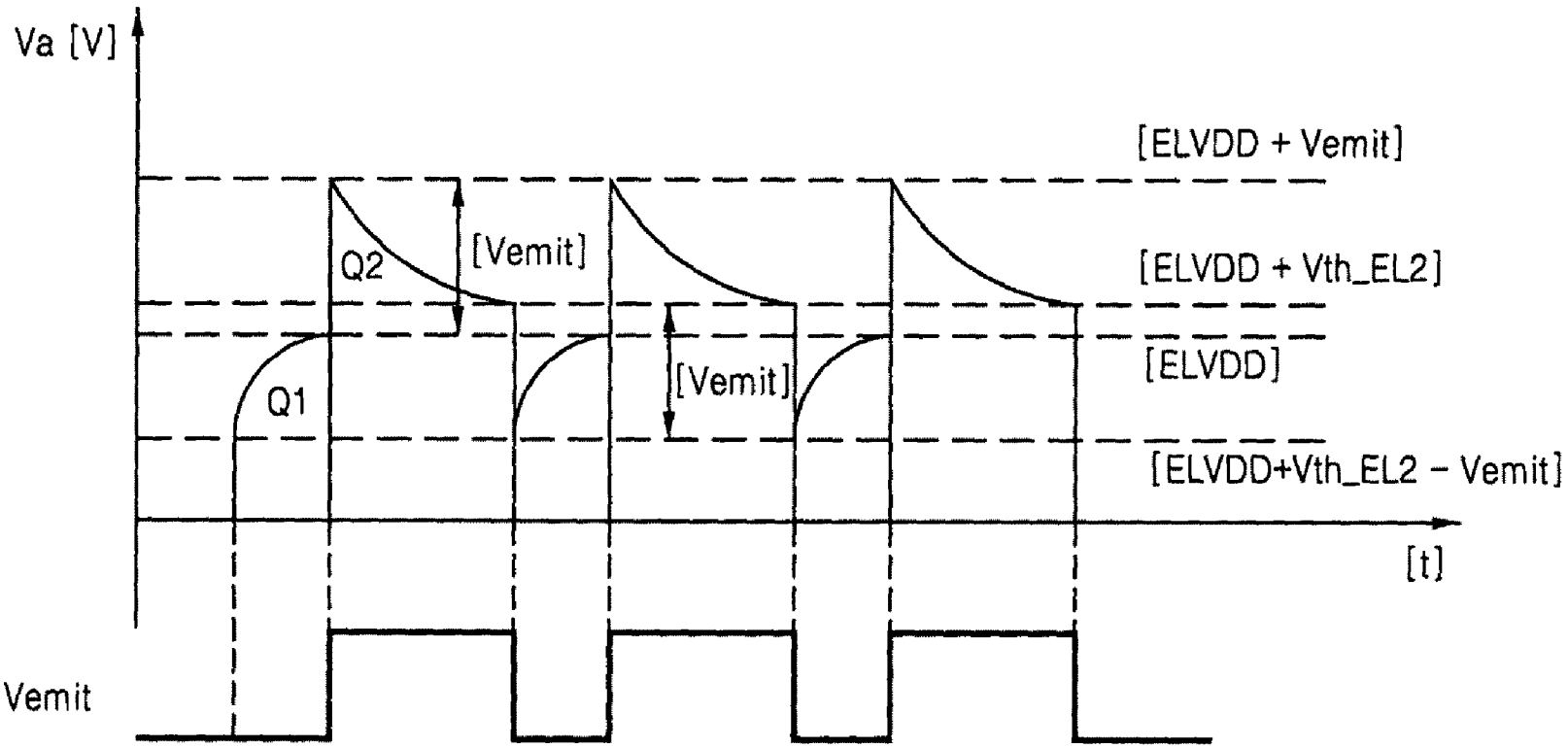
FIG. 16 is a voltage waveform diagram for explaining an exemplary embodiment of the present invention of a method for driving the light emitting pixel of FIG. 15 in a light emitting period.

FIG. 16 is a voltage waveform diagram for explaining an exemplary embodiment of a method for driving the light emitting pixel of FIG. 15 during a light emitting period. FIG. 16 shows the change in the level of the voltage Va of the first node N1 and the movement of the electric charge when the first voltage ELVDD has a constant level and the second voltage Vemit swings between the low level and the high level a predetermined number of times.

Referring to FIGS. 15 and 16, when the switching circuit 120 is turned on in response to the scan signal SCAN and the data signal DATA, the switching circuit 120 supplies the second voltage Vemit to the first electrode 132 of the first capacitor 130.

When the second voltage Vemit having the low level is supplied to the second electrode 132 of the first capacitor 130, the switching device 410, which may be embodied by the PMOS transistor (not shown), supplies the electric charge Q1 generated by the first power line to the first node N1. Thus, the voltage Va of the first node n1 increases up to the voltage ELVDD of the first power line. Because the voltage of the anode of the second OLED 340 is the same as that of the cathode thereof, current does not flow in the second OLED 340. Thus, the second OLED 340 does not emit light.

When the second voltage Vemit is transited to the high level, the voltage Va of the first node N1 increases up to the second level ELVDD+Vemit. As a result, a difference in the voltage between the anode and cathode of the second OLED 340 is generated. Thus, the electric charge Q1 charged in the first capacitor 130 is discharged toward the first power line through the second OLED 340 and in this example Q1=Q2.

Figure 17:
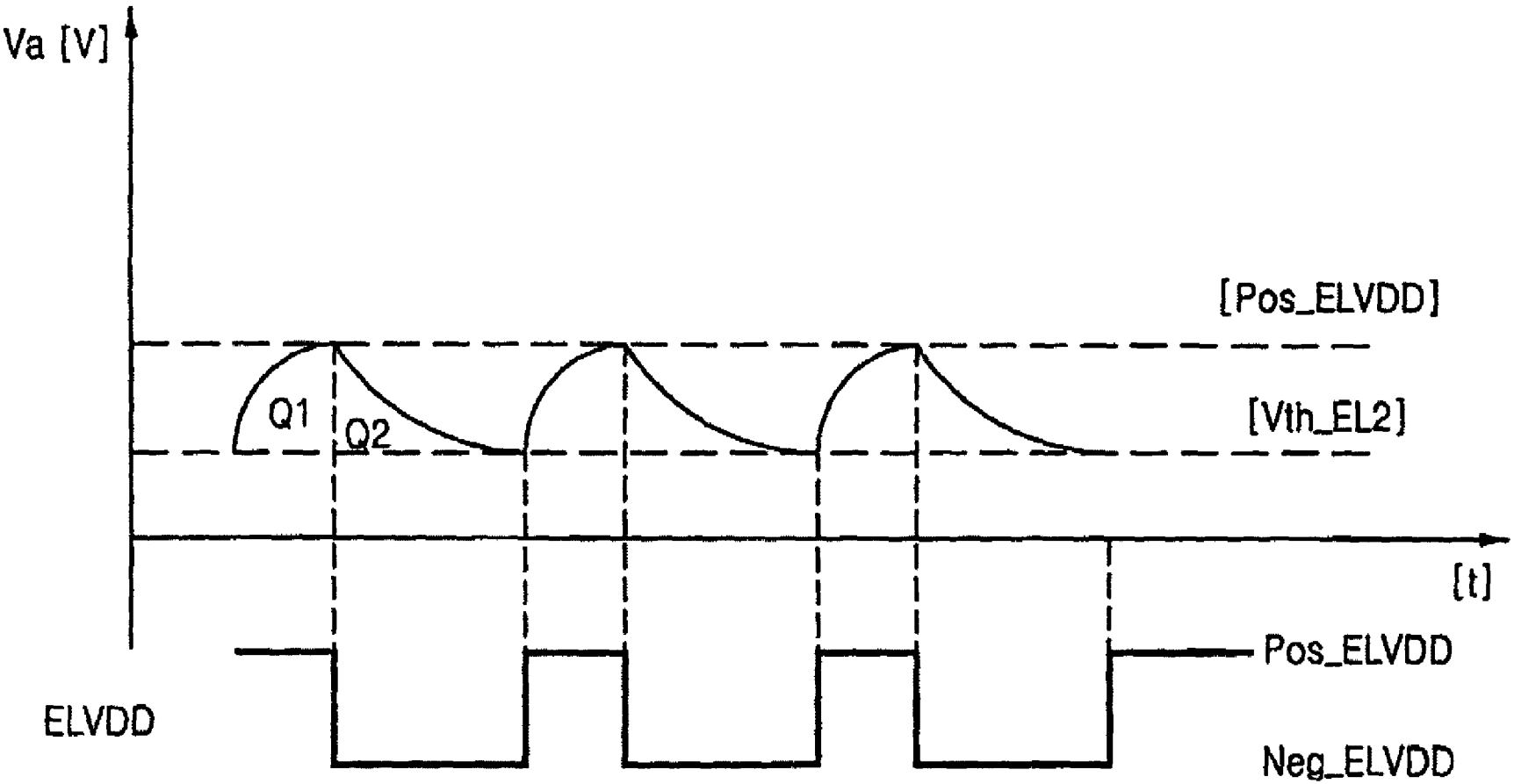
FIG. 17 is a voltage waveform diagram for explaining an exemplary embodiment of the present invention of the method for driving the light emitting pixel of FIG. 15 in a light emitting period.

FIG. 17 is a voltage waveform diagram for explaining an exemplary embodiment of the method for driving the light emitting pixel of FIG. 15 during a light emitting period. FIG. 17 shows the change in the level of the voltage Va of the first node N1 and the movement of the electric charge when the second voltage Vemit has a constant low level and the voltage ELVDD of the first power line swings between the third level Neg_ELVDD and the fourth level Pos_ELVDD a predetermined number of times. In this exemplary embodiment, the fourth level Pos_ELVDD is higher than the third level Neg_ELVDD.

As shown in FIG. 17, when the voltage ELVDD of the first power line has the fourth level Pos_ELVDD, the switching device 410 (SW3) in response to the second voltage Vemit having the low level supplies the voltage ELVDD of the first power line having the fourth level Pos_ELVDD to the first node N1. Thus, because the electric charge Q1 generated by the first power line is charged in the first capacitor 130, the first node N1 increases up to the fourth level Pos_ELVDD.

Because the voltage Pos_ELVDD of the anode and the voltage Pos_ELVDD of the cathode of the second OLED 340 are the same, however, current does not flow in the second OLED 340. When the voltage ELVDD of the first power line is transited to the third level Neg_ELVDD that is lower than the fourth level Pos_ELVDD, because the voltage ELVDD=Pos_ELVDD of the cathode of the second OLED 340 is lower than the voltage Va=Pos_ELVDD of the first node N1, there is a difference in the voltage between the anode and cathode of the second OLED 340. Thus, the electric charge Q1 charged in the first capacitor 130 is discharged through the second OLED 340. The second OLED 340 emits light in response to the current generated by the electric charge Q2 discharged from the first capacitor 130.

If the voltage ELVDD is toggled between the third level Neg_ELVDD and the fourth level Pos_ELVDD a plurality of times during the light emitting period of a sub-frame, because the amount of current flowing in the second OLED 340 varies according to the number of toggling or the number of light emission, the second OLED 340 can represent a gray value according to the integration value of the amount of light that is emitted.

Each of the light emitting pixels 100, 200, 300, and 400 according to the above-described exemplary embodiments of the present invention can represent a gray value in response to the voltage of the first power line or the voltage of the second power line that toggles a different number of times for each sub-frame. Although the OLED is explained as an example of a light emitting device in the present specification, because the OLED is only one example of an electric-to-optical conversion, the technical concept of the exemplary embodiments of the present invention can be adopted by any light emitting device including the electric-to-optical conversion.

As described above, because the light emitting pixel according to exemplary embodiments including the capacitor used as a current source and an OLED can always supply a constant current to the OLED regardless of the degradation of the characteristic of the light emitting pixel an effect of obtaining a constant brightness can be obtained after time passes.

Also, because the light emitting pixel can always supply a constant current to the OLED regardless of the degradation of the characteristic of the light emitting pixel, stress applied to the OLED can be reduced. Thus, the life of the light emitting pixel is improved.

Furthermore, because the driver to drive the light emitting pixel according to exemplary embodiments of the present invention can supply a voltage that toggles a predetermined number of times during the light emitting period to the light emitting pixel, the brightness of the light emitting pixel can be stabilized.

While this invention has been particularly shown and described with reference to exemplary embodiments thereof, it will be understood by those of ordinary skill in the art that various changes in form and details may be made therein without departing from the spirit and scope of the invention, as defined by the appended claims.

What is claimed is:

1. A light emitting pixel comprising:

a first organic light emitting diode (OLED);

a capacitor supplying to the first OLED a current generated by an electric charge corresponding to a difference between a first voltage supplied to a first electrode of the capacitor and a second voltage supplied to a second electrode of the capacitor, and a switching circuit supplying the second voltage to the second electrode by being switched based on a scan signal input through a scan line and a data signal input through a data line, wherein the first voltage is supplied to the first electrode through a second OLED.

2. The light emitting pixel of claim 1, further comprising a voltage supply to provide the first voltage to the second OLED.

3. The light emitting pixel of claim 1, wherein one of the first voltage and the second voltage is toggled a predetermined number of times for each light emitting period.

4. A method for representing a gradation of a light emitting pixel, the method comprising:

charging an electric charge corresponding to a difference between a first voltage and a second voltage in a capacitor;

representing a gradation in response to current corresponding to the electric charge charged in the capacitor using a first organic light emitting diode (OLED), and supplying to the capacitor the second voltage that toggles a predetermined number of times based on a scan signal input through a scan line and a data signal input through a data line for each light emitting period, wherein the first voltage is supplied through a second OLED.

5. The method of claim 4, further comprising supplying to the capacitor the first voltage or-the second voltage that toggles a predetermined number of times for each light emitting period.

6. A light emitting pixel comprising:

a first organic light emitting diode (OLED) connected between a first power line to supply a first voltage and a first electrode of a capacitor;

a second OLED connected between the first electrode and a second power line; and a switching circuit configured to switch in response to a scan signal input through a scan line and a data signal input through a data line to supply a second voltage to a second electrode of the capacitor, wherein the first voltage is supplied through the first OLED to the first electrode, and wherein the capacitor outputs a current to the second OLED generated by an electric charge corresponding to a difference between a voltage on the first electrode and a voltage on the second electrode.

* * * * *